US011692421B2

(12) United States Patent
Nanney

(10) Patent No.: US 11,692,421 B2
(45) Date of Patent: Jul. 4, 2023

(54) SYSTEMS AND METHODS FOR CONNECTING AND DISCONNECTING PUMPING EQUIPMENT

(71) Applicant: EOG RESOURCES, INC., Houston, TX (US)

(72) Inventor: James G. Nanney, Midland, TX (US)

(73) Assignee: EOG Resources, Inc., Houston, TX (US)

( * ) Notice: Subject to any disclaimer, the term of this patent is extended or adjusted under 35 U.S.C. 154(b) by 193 days.

(21) Appl. No.: 16/601,772

(22) Filed: Oct. 15, 2019

(65) Prior Publication Data

US 2020/0115983 A1 Apr. 16, 2020

Related U.S. Application Data

(60) Provisional application No. 62/745,869, filed on Oct. 15, 2018.

(51) Int. Cl.
*E21B 43/26* (2006.01)

(52) U.S. Cl.
CPC ..... *E21B 43/2607* (2020.05)

(58) Field of Classification Search
CPC ..... E21B 33/0355; E21B 33/038; E21B 34/02
USPC ..... 166/388
See application file for complete search history.

(56) References Cited

U.S. PATENT DOCUMENTS

| | | | | |
|---|---|---|---|---|
| 3,579,917 | A * | 5/1971 | Boettcher | B24B 37/102 451/288 |
| 6,422,315 | B1 * | 7/2002 | Dean | E21B 33/0355 166/339 |
| 9,644,443 | B1 * | 5/2017 | Johansen | E21B 33/038 |
| 2016/0153257 | A1 * | 6/2016 | Lokka | E21B 17/01 166/359 |
| 2016/0376863 | A1 * | 12/2016 | Older | F16L 1/26 166/368 |
| 2017/0093082 | A1 * | 3/2017 | Jones | H01R 13/5213 |
| 2018/0347286 | A1 * | 12/2018 | Scott | E21B 17/021 |

* cited by examiner

*Primary Examiner* — Matthew R Buck
*Assistant Examiner* — Patrick F Lambe
(74) *Attorney, Agent, or Firm* — Conley Rose, P.C.

(57) ABSTRACT

A pumping system for performing a hydraulic fracturing operation includes a first fluid conduit having a central axis, a fluid pump including an outlet configured to be inserted into the first fluid conduit, and a connector assembly including an engagement member having a first position configured to lock the outlet within the first fluid conduit and a second position configured to unlock the outlet from the first fluid conduit.

20 Claims, 6 Drawing Sheets

SYSTEMS AND METHODS FOR CONNECTING AND DISCONNECTING PUMPING EQUIPMENT

CROSS-REFERENCE TO RELATED APPLICATIONS

The present application claims benefit of U.S. provisional patent application No. 62/745,869 filed Oct. 15, 2018, entitled "Systems and Methods for Connecting and Disconnecting Pumping Equipment" which is incorporated herein by reference in its entirety for all purposes.

STATEMENT REGARDING FEDERALLY SPONSORED RESEARCH OR DEVELOPMENT

Not applicable.

BACKGROUND

The disclosure relates generally to systems and methods for connecting and disconnecting pumping equipment. More particularly, the disclosure relates to systems and methods for safely connecting and disconnecting pumping equipment to and from, respectively, a pumping system without depressurizing the full or entire pumping system.

A variety of industrial systems employ pumping equipment including systems for drilling boreholes in subterranean formations, systems for completing drilled boreholes, and systems for extracting hydrocarbons from subterranean formations via the completed boreholes. In some completion operations, a hydraulic fracturing or "fracing" system pump highly pressurized fracturing fluid down the borehole and into the surrounding subterranean formation to produce localized fractures in the formation and thereby increase fluid conductivity between the borehole and the formation (i.e., to enhance the flow of hydrocarbons from the formation into the borehole).

Typically, the completion operation is performed with a surface pumping system including a high pressure manifold supplied with pressurized fracturing fluid via a series of high pressure pumps removably connected to the high pressure manifold. In some cases, the fracturing fluid supplied by the high pressure pumps includes abrasive materials, such as sand, proppant, etc., for assisting in the formation and stabilization of the fractures formed in the formation during the completion operations. Such abrasive materials in the fracturing fluid induce wear in the high pressure pumps of the completion system, often necessitating periodic removal of one or more pumps from the manifold for maintenance, repair, or replacement. The removal of a high pressure pump may first require depressurization of the high pressure manifold to safely permit personnel (e.g., operators) to disconnect the pump from the high pressure manifold. Depressurization of the manifold interrupts the completion operation, and thus, increases the total time required to perform the hydraulic fracturing operation.

BRIEF SUMMARY OF THE DISCLOSURE

An embodiment of a pumping system for performing a hydraulic fracturing operation comprises a first fluid conduit having a central axis, a fluid pump including an outlet configured to be inserted into the first fluid conduit, and a connector assembly comprising an engagement member having a first position configured to lock the outlet within the first fluid conduit and a second position configured to unlock the outlet from the first fluid conduit. In some embodiments, the connector assembly comprises a plurality of the engagement members, wherein each engagement member has a first position configured to lock the outlet within the first fluid conduit and a second position configured to unlock the outlet from the first fluid conduit, wherein the first fluid conduit includes a plurality of circumferentially-spaced slots extending radially therethrough, and wherein each engagement member is moveably disposed in one of the plurality of slots. In some embodiments, each engagement member comprises a finger having a first end fixably coupled to the first fluid conduit and a second end opposite the first end, wherein each finger is configured to flex about the first end to move the second end radially relative to the first fluid conduit, and wherein each finger includes a tab extending radially inward from the second end and configured to engage an annular shoulder on the pump fluid conduit when the engagement member is in the first position. In certain embodiments, each engagement member comprises a cam pivotably coupled to the first fluid conduit. In certain embodiments, the connector assembly further comprises an annular lock disposed about the first fluid conduit and configured to selectably lock the engagement member in the first position. In some embodiments, the connector assembly further comprises an actuator configured to actuate the lock between an unlocked position and a locked position. In some embodiments, the pumping system further comprises a control system configured to remotely actuate the engagement member of the connector assembly between the first position and the second position. In some embodiments, the pumping system further comprises at least one valve disposed along the first fluid conduit, wherein the valve is configured to be actuated from an open position to a closed position by the control system to isolate the outlet from a manifold coupled to the first fluid conduit. In certain embodiments, the pumping system further comprises an annular pressure cup coupled to an outer surface of the pump outlet, wherein the pressure cup comprises a radially retracted position and a radially expanded position whereby an outer surface of the pressure cup sealingly engages an inner surface of the first fluid conduit when the pump outlet is inserted into the first fluid conduit.

An embodiment of a pumping system for performing a hydraulic fracturing operation comprises a first fluid conduit having a central axis, a fluid pump comprising an outlet configured to be inserted into the first fluid conduit, a connector assembly comprising an engagement member having a first position configured to lock the outlet to the first fluid conduit and a second position configured to unlock the outlet from the first fluid conduit, and a control system configured to remotely actuate the engagement member of the connector assembly between the first position and the second position. In some embodiments, the first position of the engagement member comprises a radially inner position and the second position comprises a radially outer position, and wherein the engagement member is configured to engage a shoulder formed on the outlet when the engagement member is disposed in the radially inner position. In some embodiments, the engagement member comprises a finger having a first end fixably coupled to the first fluid conduit and a second end opposite the first end, wherein each finger is configured to flex about the first end to move the second end radially relative to the first fluid conduit, and wherein each finger includes a tab extending radially inward from the second end and configured to engage an annular shoulder formed on the outlet when the engagement member is in the radially inner position. In certain embodiments, the engagement member comprises a cam that is pivotably coupled to the first fluid conduit by a pivot joint. In certain embodiments, the connector assembly further comprises an annular lock disposed about the first fluid conduit and configured to selectably lock the engagement member in the first position, and an actuator configured to actuate the lock between an unlocked position and a locked position, wherein the actuator is controllable by signals transmitted from the control system. In some embodiments, the pumping system further comprises a pair of inlet valves disposed along the first fluid conduit, wherein the first fluid conduit comprises an inlet conduit extending from a manifold, a pair of branch conduits extending from the inlet conduit, wherein a branch valve is disposed along each of the pair of branch conduits, a dump conduit extending from the pair of branch conduits, wherein a dump valve is disposed along the dump conduit, and wherein each of the inlet valves, branch valves, and the dump valve are configured to be actuated from an open position to a closed position by the control system. In some embodiments, the pumping system further comprises an inlet pressure sensor coupled to the inlet conduit, and a dump pressure sensor coupled to the dump conduit, wherein the control system comprises an interface configured to indicate pressure measurements made by the inlet pressure sensor and the dump pressure sensor. In some embodiments, the pair of inlet valves provide a dual seal barrier between the manifold and the outlet, and wherein the pair of branch valves and the dump valve provide a dual seal barrier between the manifold and an outlet of the dump conduit. In certain embodiments, the pumping system further comprises an annular pressure cup coupled to an outer surface of the pump outlet, wherein the pressure cup comprises a radially retracted position and a radially expanded position whereby an outer surface of the pressure cup sealingly engages an inner surface of the first fluid conduit when the pump outlet is inserted into the first fluid conduit.

An embodiment of a pumping system for performing a hydraulic fracturing operation comprises an inlet conduit extending from a manifold, wherein a pair of inlet valves disposed along the inlet conduit, a pair of branch conduits extending from the inlet conduit, a pair of branch valves, wherein one of the pair of branch valves is disposed along each of the pair of branch conduits, a dump conduit extending from the pair of branch conduits, wherein a dump valve is disposed along the dump conduit, and a fluid pump including an outlet coupled to the inlet conduit. In some embodiments, the pumping system further comprises a connector assembly comprising an engagement member having a first position configured to lock the outlet within the first fluid conduit and a second position configured to unlock the outlet from the first fluid conduit. In some embodiments, the pumping system further comprises a control system configured to remotely actuate the engagement member of the connector assembly between the first position and the second position. In certain embodiments, the pair of inlet valves, the pair of branch valves, and the dump valve are each configured to be actuated from an open position to a closed position by the control system. In certain embodiments, the pumping system further comprises an annular pressure cup coupled to an outer surface of the pump outlet, wherein the pressure cup comprises a radially retracted position and a radially expanded position whereby an outer surface of the pressure cup sealingly engages an inner surface of the first fluid conduit when the pump outlet is inserted into the first fluid conduit.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of the disclosed embodiments of the invention, reference will now be made to the accompanying drawings in which.

DETAILED DESCRIPTION OF THE DISCLOSED EMBODIMENTS

Figure 1:
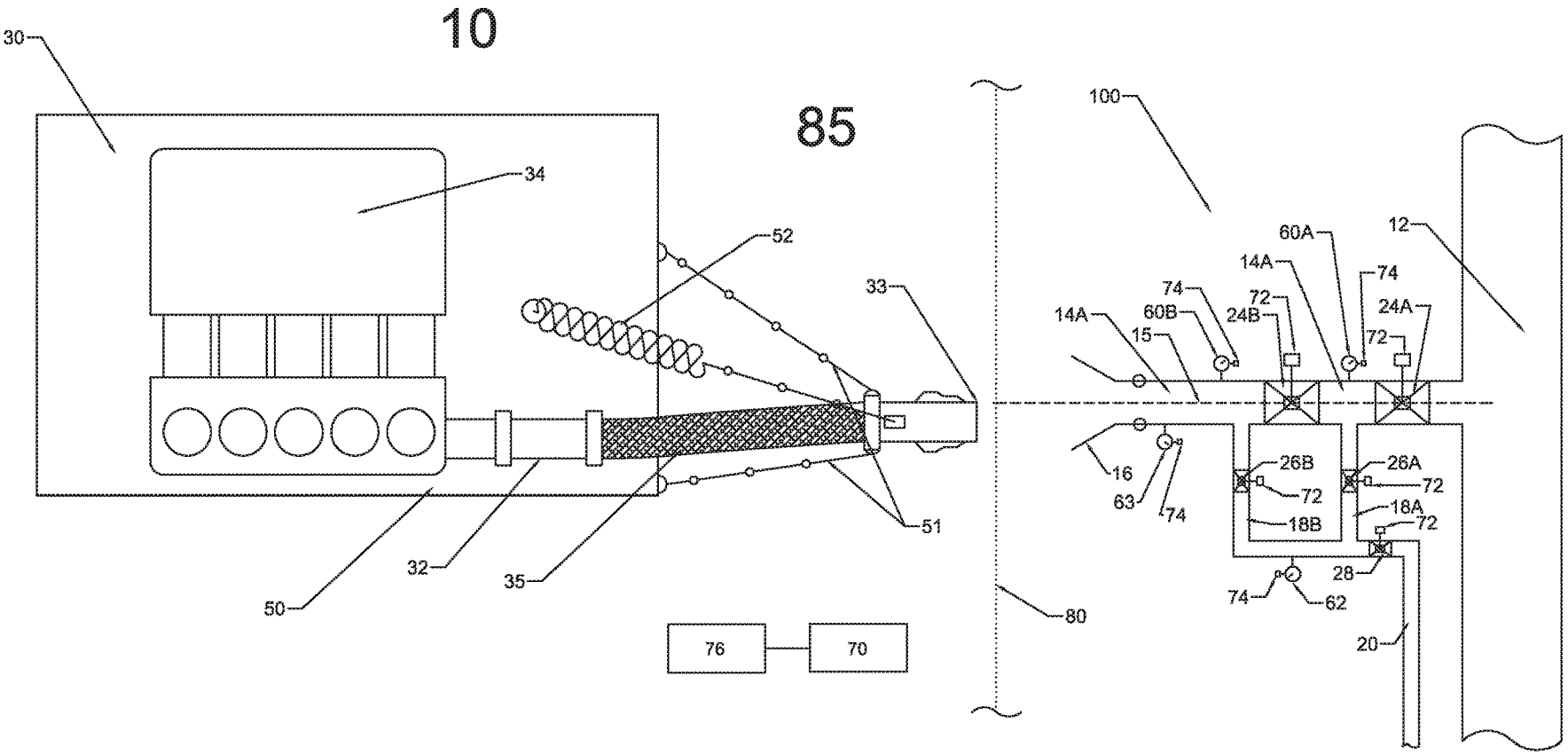
FIG. 1 is a schematic view of an embodiment of a pumping system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation.

Referring now to FIG. 1, an embodiment of a pumping system 10 for performing a well stimulation or hydraulic fracturing operation is shown. In this embodiment, pumping system 10 generally includes a high pressure manifold 12, a fluid inlet conduit 14, a pair of branch conduits 18A, 18B, a relief or dump conduit 20, a pair of inlet valves 24A, 24B disposed along inlet conduit 14, a pair of branch valves 26A, 26B disposed along branch conduits 18A, 18B, respectively, a dump valve 28 disposed along dump conduit 20, and a high pressure fluid pump 30 removably coupled to inlet conduit 14. Inlet conduit 14 has a central or longitudinal axis 15. In some embodiments, the high pressure manifold 12 is operated at a pressure approximately between 10,000 and 20,000 pounds per square inch (PSI); however, in other embodiments, the operating pressure of high pressure manifold 12 may vary.

Branch conduits 18A, 18B extend from inlet conduit 14 to dump conduit 20. Valves 24A, 24B are disposed along conduit 14 between pump 30 and manifold 12, and thus, selectively control fluid communication between pump 30 and manifold 12. In this embodiment, valve 24B is positioned along conduit 14 between branch conduits 18A, 18B and valve 24A is positioned along conduit 14 between manifold 12 and both branch conduits 18A, 18B. Valves 26A, 26B selectively control the flow of fluid through branch conduits 18A, 18B, respectively, and dump valve 28 selectively controls the flow of fluid through dump conduit 20. Thus, valves 26A, 26B, 28 selectively control fluid communication between inlet conduit 14 and dump conduit 20. As will be described in more detail below, dump conduit 20 selectively dumps pressurized fluid in pump outlet 32, inlet conduit 14, branch conduits 18A, 18B, or combinations thereof to a dump tank or other apparatus to safely depressurize pump outlet 32, inlet conduit 14, branch conduits 18A, 18B, or combinations thereof.

Pump 30 includes an outlet or stinger 32 extending from a pump body 34. Outlet 32 supplies pressurized fluid from pump 30 to inlet conduit 14, and thus, may also be referred to as a pump outlet. As will be described in more detail below, a connector assembly 100 releasably connects and securing pump outlet 32 within an inlet or terminal end 16 of inlet conduit 14 such that inlet conduit 14 and pump outlet 32 are sealed and isolated from the surrounding environment. In this embodiment, pump outlet 32 comprises a flexible hose 35 extending between a terminal end 33 of pump outlet 32 and pump body 34, where flexible hose 35 allows for the terminal end 33 of pump outlet 32 to be flexibly inserted into the terminal end 16 of the inlet conduit 14 of pumping system 10. Additionally, in this embodiment, pump outlet 32 comprises one or more restraints 51, and one more or stretchable support cords 52. Restraints 51 and support cords 52 each extend between pump body 34 and the portion of pump outlet 32 extending between flexible hose 35 and the terminal end 33 of pump outlet 32 to physically support terminal end 33 as the terminal end 33 is guided or inserted into the terminal end 16 of inlet conduit 14.

As shown in FIG. 1, in this embodiment, pumping system 10 forms a part of a completion or hydraulic fracturing system for pumping a fracturing fluid through manifold 12 and a subterranean borehole into the surrounding formation in a fracturing operation. Thus, in this embodiment, pump 30 supplies high pressure manifold 12 with pressurized fracturing fluid via the pump outlet 32, which is insertable into terminal end 16 of inlet conduit 14. However, in general, pumping system 10 can be used as a part of other systems or processes. Although pumping system 10 shown in FIG. 1 illustrates one pump 30 coupled to manifold 12, it should be appreciated that a plurality of pumping systems (e.g., systems 10) can be coupled to manifold 12 in parallel to simultaneously provide pressurized fluid to manifold 12.

Referring still to FIG. 1, pump 30 is supported on a platform 50. In this embodiment, platform 50 comprises a trailer, and thus, is moveable relative to manifold 12. However, in other embodiments, movable platform 50 may comprise other types of vehicles or mechanisms for manipulating the position of pump 30 relative to high pressure manifold 12. In still other embodiments, pump 30 may be supported or mounted on a stationary skid proximate inlet conduit 30 where pump outlet 32 and inlet conduit 14 are movable relative to each other. Pump 30 is supplied with fracturing fluid via a fluid source (not shown in FIG. 1), and pressurizes the fracturing fluid prior to supplying the fluid to high pressure manifold 12. In this embodiment, the fracturing fluid supplied to pump 30 includes abrasive materials such as sand or proppant, that may require the periodic disconnection of pump 30 (including pump outlet 32) from inlet conduit 14 for maintenance, repair, replacement, or combinations thereof.

In this embodiment, terminal end 16 of inlet conduit 14 comprises a flared or frustoconical receptacle to guide the terminal end 33 of pump outlet 32 into end 16 and inlet conduit 14 to connect pump 30 to inlet conduit 14. First inlet valve 24A is disposed along inlet conduit 14 between high pressure manifold 12 and first branch conduit 18A, and second inlet valve 24B is positioned along inlet conduit 14 between both branch conduits 18A, 18B. Dump valve 28 is disposed on dump conduit 20 downstream of both branch conduits 18A, 18B. In other words, both branch conduits 18A, 18B are disposed between inlet conduit 14 and dump valve 28. In this embodiment, a first inlet pressure sensor 60A is coupled to inlet conduit 14 between inlet valves 24A, 24B while a second inlet pressure sensor 60B is coupled to inlet conduit 14 between second inlet valve 24B and the terminal end 16 of inlet conduit 14. A dump pressure sensor 62 is coupled to dump conduit 20 between branch conduits 18A, 18B and dump valve 28. Additionally, a seal failure pressure sensor 63 is coupled to inlet conduit 14 proximal the terminal end 16 of inlet conduit 14.

In this embodiment, pumping system 10 also includes a control system 70 for monitoring and controlling pumping system 10. In particular, each valve 24A, 24B, 26A, 26B, 28 is coupled to an actuator 72 that actuates the corresponding valve 24A, 24B, 26A, 26B, 28 between an open position allowing fluid flow therethrough and a closed position preventing fluid flow therethrough in response to signals transmitted to actuators 72 by control system 70. In addition to selectively and independently controlling each valve 24A, 24B, 26A, 26B, 28, control system 70 monitors the position of each valve 24A, 24B, 26A, 26B, 28. As will be described in more detail below, control system 70 can also actuate connector assembly 100 to connect and disconnect pump outlet 32 and inlet conduit 14. Each of the pressure sensors 60A, 60B, 62, and 63 is coupled to a transmitter 74 that communicates the pressure measured by each sensor 60A, 60B, 62, and 63 to control system 70 in real-time or near real-time. In this embodiment, actuators 72 and transmitters 74 communicate with control system 70 wirelessly; however, in other embodiments, actuators 72 and/or transmitters 74 may communicate with control system 70 via a hard-wired connection. In this embodiment, control system 70 communicates with an interface 76 used by operators of pumping system 10 to remotely monitor the measurements made by pressure sensors 60A, 60B, 62, and 63 to monitor the positions of valves 24A, 24B, 26A, 26B, 28, and to control the operation of valves 24A, 24B, 26A, 26B, 28.

Due to the presence of highly pressurized fluid in high pressure manifold 12, even when pump 30 is shut off, operators of pumping system 10 (or other personnel working in the same location as system 10) may be prohibited from moving within a predetermined distance of manifold 12 to minimize potential exposure to high pressure fluid within manifold 12 in the event of a catastrophic failure of the physical integrity of high pressure manifold 12. This "danger zone" is indicated in FIG. 1 by safety line 80 that extends parallel with high pressure manifold 12 and defines a safe zone 82 extending from safety line 80 in a direction opposite manifold 12. In other words, even when pump 30 is disabled, personnel are generally prohibited from crossing safety line 80 while high pressure manifold 12 is pressurized. In some embodiments, low pressure fluid to be pressurized by pump 30 is provided to an inlet of pump 30 via one or more lines (not shown) extending between pump 30 and a low pressure fluid supply of pumping system 10, where the one or more lines may be connectable to pump 30 by personnel of pumping system 10 positioned outside of the danger zone defined by safety line 80.

In view of the above, personnel are generally prohibited from manually actuating valves 24A, 24B, 26A, 26B, 28 and connector assembly 100, and further, are generally prohibited from directly monitoring pressure sensors 60A, 60B, 62, and 63 when manifold 12 is pressurized given that valves 24A, 24B, 26A, 26B, 28, connector assembly 100, and pressure sensors 60A, 60B, 62 are each positioned between safety line 80 and high pressure manifold 12. Thus, high pressure manifold 12 is depressurized or taken off-line to allow for the safe manual actuation of valves 24A, 24B, 26A, 26B, 28 and connector assembly 100, or direct monitoring of pressure sensors 60A, 60B, 62, and 63. However, in this embodiment, interface 76 is positioned distal high pressure manifold 12 and on the opposite side of safety line 80 from manifold 12, thereby permitting the safe, remote actuation of valves 24A, 24B, 26A, 26B, 28 and connector assembly 100, and monitoring of pressure sensors 60A, 60B, 62, and 63 via control system 70. Given that control system 70 permits the remote operations of pumping system 10, embodiments described herein offer the potential to safely actuate valves 24A, 24B, 26A, 26B, 28 and connector assembly 100, as well as indirectly monitor of pressure sensors 60A, 60B, 62, and 63 without depressurization of high pressure manifold 12. As will be described in more detail below, control system 70 and connector assembly 100 also permit pump 30 to be connected to and disconnected from high pressure manifold 12 without depressurization of high pressure manifold 12, thereby reducing stoppages in the operation of pumping system 10 and decreasing the total time required for performing the hydraulic fracturing operation using pumping system 10.

Figure 2:
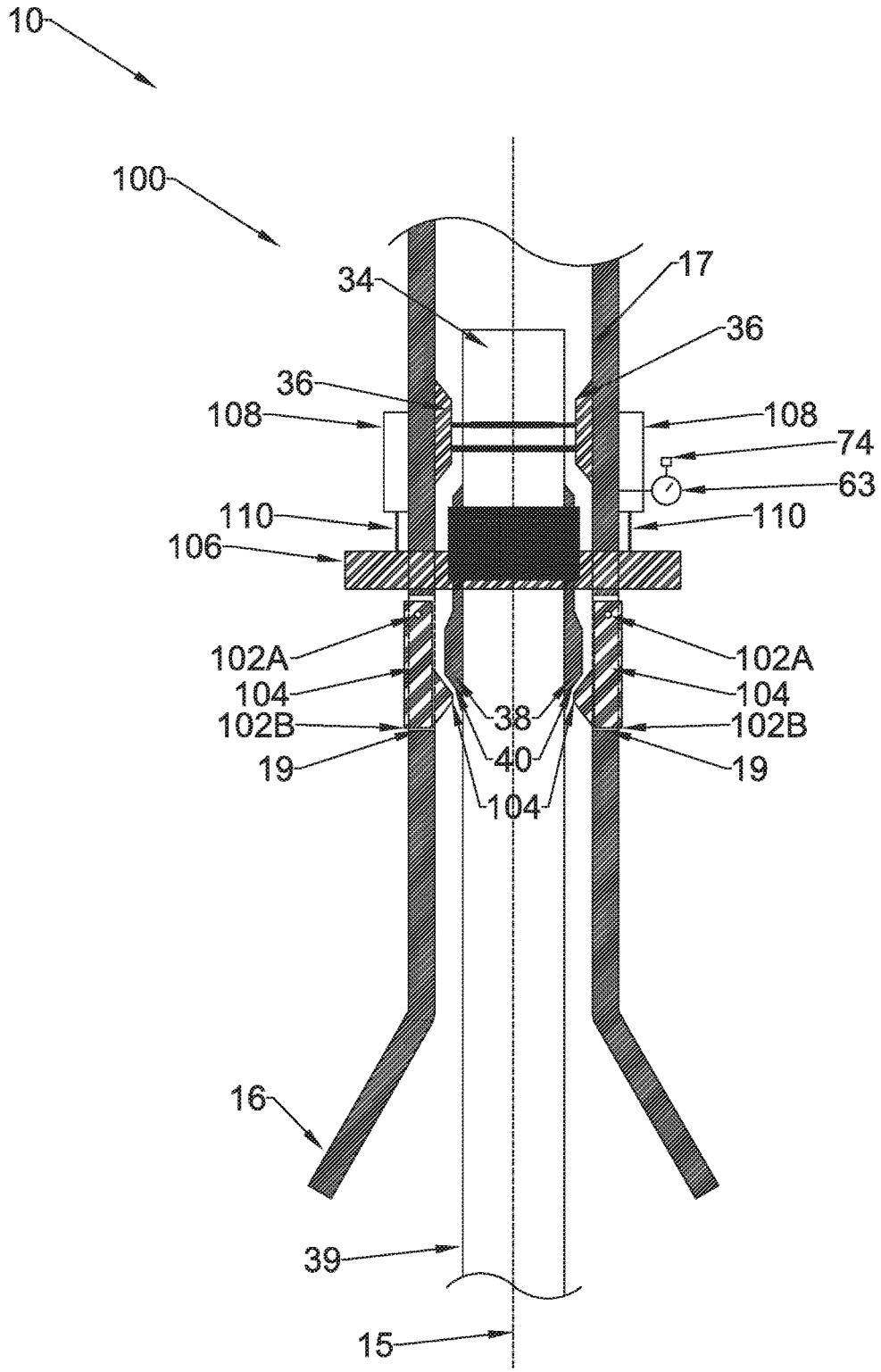
FIG. 2 is a schematic view of the connector assembly of FIG. 1 disposed in a first position.
Figure 3:
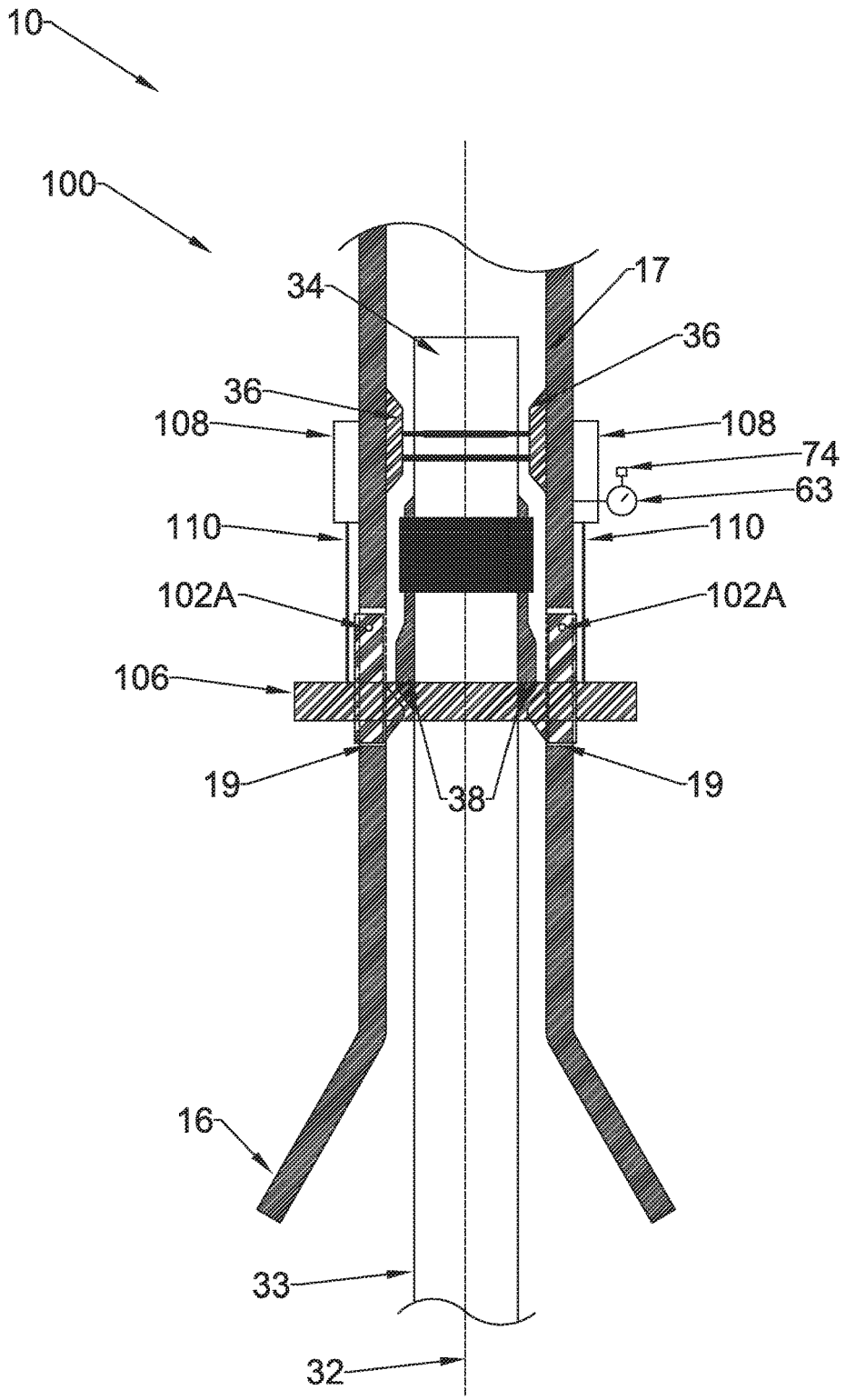
FIG. 3 is a schematic view of the connector assembly of FIG. 1 disposed in a second position.

Referring now to FIGS. 2 and 3, connector assembly 100 is shown. In this, an annular seal 36 is coupled to pump outlet 32 proximal terminal end 33. An annular inner surface of seal 36 sealingly engages an outer surface 39 of pump outlet 32 and an annular outer surface of seal 36 sealingly engages an inner surface 17 of inlet conduit 14 when pump outlet 32 is disposed in inlet conduit 14 (as shown in FIG. 2). In this configuration, seal 36 prevents fluid flowing from pump outlet 32 into inlet conduit 14 from communicating with the surrounding environment. An annular connector or hub 38 for engaging the connector assembly 100 is disposed along outlet 32 proximal terminal end 33. Hub 38 extends radially outward from outlet 32.

In this embodiment, a flexible pressure boot or cup 37 is coupled to the outer surface of hub 38. Particularly, pressure cup 37 comprises a flexible, elastomeric material and comprises a first end that is attached or coupled to the outer surface of hub 38, and a second end positioned between the first end and terminal end 33 of pump outlet 32 that is configured to flex radially outwards into sealing engagement with the inner surface 17 of inlet conduit 14 in response to the creation of a pressure differential in the annulus formed between the outer surface 39 of pump outlet 32 and the inner surface 17 of inlet conduit 14. For example, in the event of a failure of annular seal 36 to maintain sealing integrity with the inner surface 17 of inlet conduit 14, thereby creating a pressure differential across pressure cup 37. The pressure differential exerts a pressure force against an inner surface of pressure cup 37, thereby forcing pressure cup 37 radially outwards into sealing engagement with the inner surface 17 of inlet conduit 14, thereby maintain sealing integrity between pressure cup 37 and the inner surface 17 of inlet conduit 14 even in the event of a failure of annular seal 36 to maintain sealing engagement with inner surface 17.

Given that in this embodiment seal failure pressure sensor 63 is positioned between annular seal 36 and the terminal end 16 of inlet conduit 14, seal failure pressure sensor 63 registers or measures fluid pressure in the portion of the annulus formed between pump outlet 32 and inlet conduit 14 that extends between annular seal 36 and terminal end 16 of inlet conduit 14, and thus an increase in fluid pressure registered by seal failure pressure sensor 63 indicates a leak of pressurized fluid past annular seal 36. Thus, in some embodiments, control system 70 is configured to alert an alarm to a user or operator of pumping system 10 in response to an increase in pressure registered by seal failure pressure sensor 63 being transmitted to control system 70 via the transmitter 74 coupled to seal failure pressure sensor 63.

Connector assembly 100 is coupled to inlet conduit 14 proximal terminal end 16 of conduit 14. In this embodiment, connector assembly 100 generally includes a plurality of circumferentially spaced locking members or fingers 102, an annular lock 106 moveably disposed about inlet conduit 14, and a plurality of first or lock actuators 108 coupled to annular lock 106. Each finger 102 of connector assembly 100 is at least partially received in one of a plurality of circumferentially spaced recesses or slots 19 formed in the radially inner surface of inlet conduit 14 proximal terminal end 16. Particularly, each slot 18 radially extends entirely through inlet conduit 14 and a radially outer surface of each finger 102 is positioned substantially flush with an outer surface of inlet conduit 14. Additionally, each finger 102 includes a first end 102A and a second end 1026 opposite first end 102A. Each end 102A is fixably coupled or affixed to inlet conduit 14 such that it cannot move rotationally or translationally relative to inlet conduit 14, however, fingers 102 can pivot about ends 102A to move ends 102B radially relative to inlet conduit 14. Second end 102B of each finger 102 includes a projection or locking tab 104 that extends radially inward from the corresponding finger 102. Each tab 104 is configured to engage annular shoulders 40 of hub 38.

Lock 106 of connector assembly 100 surrounds fingers 102 and can be moved axially relative to inlet conduit 14 by actuators 108 between a first or unlocked position as shown in FIG. 2 and a second or locked position as shown in FIG. 3. Particularly, a radially inner surface of the annular lock 106 is disposed directly adjacent the radially outer surface of each finger 102. In the unlocked position (FIG. 2), lock 106 is axially positioned proximal first ends 102A of fingers 102, thereby allowing tabs 104 to flex radially outward through recesses 18 to allow relative axial movement between hub 38 and fingers 102. In other words, hub 38 of pump outlet 32 may pass under tabs 104 and urge tabs 104 and ends 102B radially outward when lock 106 is in the unlocked position. However, when lock 106 is disposed in the locked position (FIG. 3), lock 106 is axially positioned proximal ends 102B with the inner surface of lock 106 disposed directly adjacent the radially outer surface of each finger 102, thereby preventing ends 102B and tabs 104 from flexing radially outward and preventing hub 38 and outlet 32 from being pulled axially (to the left in FIG. 3) from inlet conduit 14. In other words, with pump outlet 32 received in the inlet conduit 14, pump outlet 32 is restricted from being removed or disconnected from inlet conduit 14 when lock 106 is in the locked position due to physical engagement between tabs 104 and annular shoulder 40 of hub 38 of pump outlet 32.

Lock actuators 108 actuate or transition lock 106 between the unlocked and locked positions to thereby selectively lock pump outlet 32 to inlet conduit 14. In this embodiment, each lock actuator 108 is a hydraulic actuator configured to extend and retract an arm 110 coupled between lock 106 and lock actuator 108; however, in other embodiments, lock actuators 108 may comprise other types of actuators and/or motors known in the art, including linear motors. Lock actuators 108 and arms 110 are uniformly circumferentially spaced about inlet conduit 14. In this embodiment, lock actuators 108 are controlled by control system 70 to transition lock 106 between the locked and unlocked positions.

In this embodiment, the position of lock 106 (i.e., in the unlocked or locked position) is communicated to and indicated by interface 76 of control system 70 via signals transmitted to control system 70 from lock actuators 108. In this configuration, connector assembly 100 may be remotely monitored and controlled via control system 70 by operators of pumping system 10 while positioned in safe zone 82.

Figure 4:
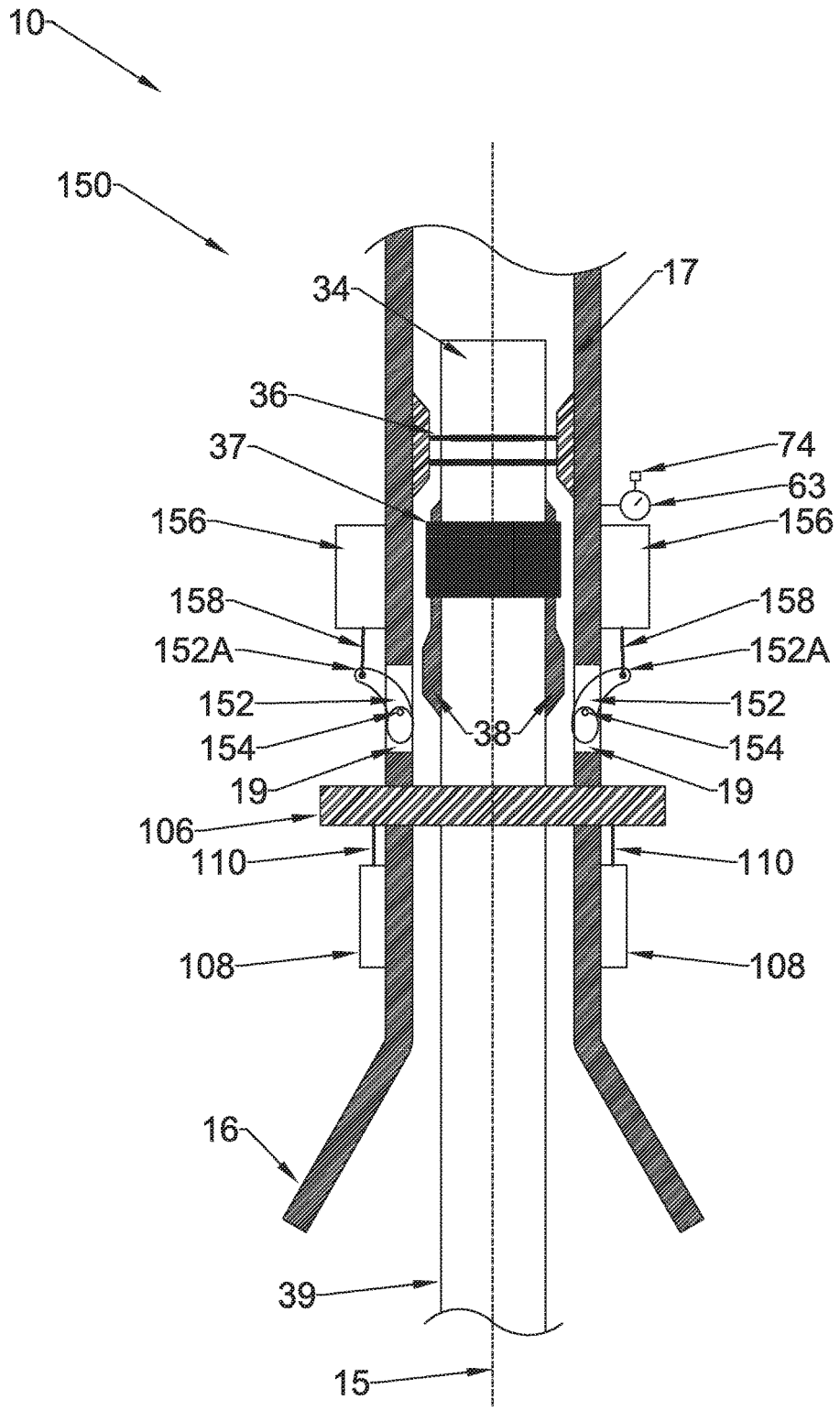
FIG. 4 is a schematic view of an embodiment of a connector assembly in accordance with the principles described herein disposed in a first position.
Figure 5:
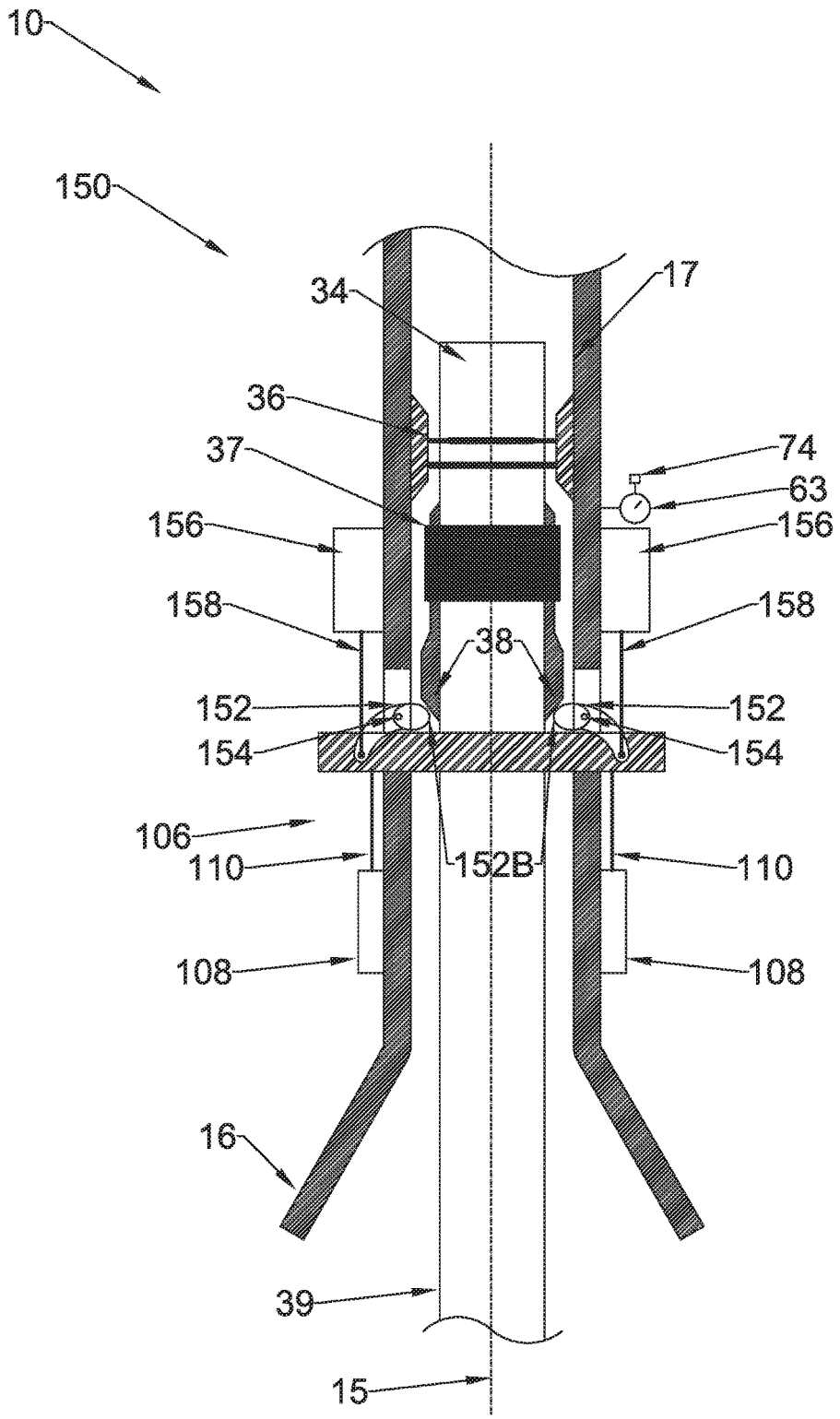
FIG. 5 is a schematic view of the connector assembly of FIG. 4 disposed in a second position.
Figure 6:
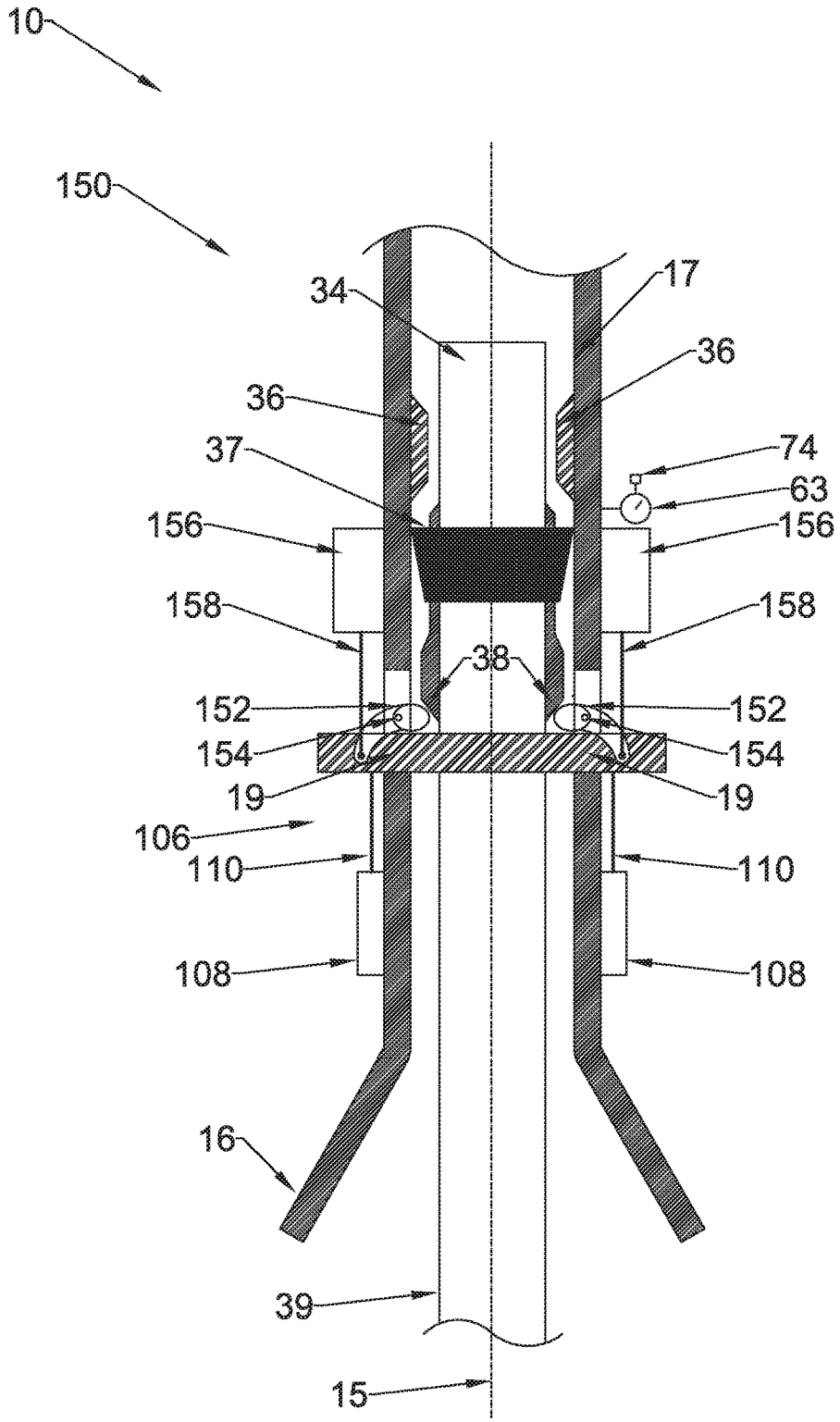
FIG. 6 is a schematic view of the connector assembly of FIG. 4 disposed in a third position.

Referring now to FIGS. 4-6, an alternative embodiment of a connector assembly 150 that can be used in place of connector assembly 100 previously described is shown in FIGS. 4-6. Connector assembly 150 can be used to connect and disconnect pump outlet 32 of pump 30 from inlet conduit 14. In this embodiment, connector assembly 150 generally includes lock 106, lock actuators 108, a plurality of circumferentially spaced engagement members or cams 152, and a plurality of circumferentially spaced cam actuators 156. Lock 106 and lock actuators 108 are both as previously described. In this embodiment, each cam 152 is received in one of the slots 19 formed in inlet conduit 17 and includes a first or radially outer end 152A and a second or radially inner end 152B disposed opposite radially outer end 152A. Each radially inner end 152B defines a cam surface.

Each cam 152 is pivotably coupled to inlet conduit 14 at a pivotal coupling or pin joint 154 that defines an axis of rotation for each cam 152. In this configuration, each cam 152 is permitted to rotate about pivot joint 154 between a first or disengaged position (shown in FIG. 4) with the radially inner end 152B of each cam 152 radially withdrawn and spaced from outer surface 39 of pump outlet 32 and a second or engaged position (shown in FIGS. 5, 6) with the radially inner end 152B of each cam 152 radially abutting or adjacent outer surface 39 of pump outlet 32. Thus, each cam 152 can be rotated about its pivot joint 154 between the engaged position and the disengaged position. When pump outlet 32 is sufficiently inserted into inlet conduit 14 and cams 152 are in the engaged positions, as shown in FIGS. 5, 6, radially inner end 1526 of each cam 152 physically engages and axially abuts shoulder 40 of hub 38, thereby preventing hub 38 and outlet 32 from being pulled axially from inlet conduit 14. However, when cams 152 are in the disengaged positions (shown in FIG. 4), the radially inner end 152B of each cam 152 is radially withdrawn from shoulders 40, thereby allowing hub 38 and outlet 32 to be pulled axially from inlet conduit 14.

The cam actuators 156 actuate or rotate cams 152 between the disengaged and engaged positions. In this embodiment, each cam actuator 156 is a hydraulic actuator that extends and retracts an arm 158 coupled between one of the cams 152 and the cam actuator 156; however, in other embodiments, cam actuators 156 may comprise other types of actuators and/or motors known in the art, including linear motors. Cam actuators 156 and arms 158 are uniformly circumferentially spaced about an outer surface of inlet conduit 14. In this embodiment, cam actuators 156 are controlled by control system 70 to transition cams 152 between the disengaged and engaged positions.

Similar to the operation of the connector assembly 100 previously described, lock actuators 108 of the connector assembly 150 axially move lock 106 between an unlocked position (shown in FIG. 4) and a locked position (shown in FIGS. 5, 6) to selectively lock pump outlet 32 to inlet conduit 14. In particular, when lock 106 of connector assembly 150 is in the unlocked position, lock 106 is axially spaced from cams 152, and thus, cams 152 can be freely rotated by actuators 156 between the engaged and disengaged positions. However, when lock 106 is in the locked position, lock 106 is disposed about cams 152 such the inner surface of lock 106 radially abuts or is radially positioned adjacent the radially outer ends 152A of cams 152, and thus, cams 152 are prevented from being rotated by actuators 156 between the engaged and disengaged positions. More specifically, when lock 106 is in the unlocked position, lock 106 does not interfere with the actuation of cams 152 from the locked to unlocked position, however, when lock 106 is in the locked position, physical engagement between the radially outer ends 152A of cams 152 and lock 106 prevents cams 152 from actuating from the engaged position to the disengaged position. Thus, lock 106 of connector assembly 150 can selectively lock each cam 152 in the engaged position, thereby preventing the inadvertent actuation of each cam 152 from the engaged position to the disengaged position. In this embodiment, lock actuators 108 are controlled by control system 70 to move lock 106 between the unlocked and locked positions.

As described above, pressure cup 37 is configured to seal the annular interface formed between pump outlet 32 and inlet conduit 14 in response to a failure of annular seal 36 so that the surrounding environment is not exposed to fluid disposed in inlet conduit 14. Particularly, FIGS. 4, 5 illustrate pressure cup 37 in a first or radially retracted position where an outer surface of pressure cup 37 is spaced from the inner surface 16 of inlet conduit 14. Pressure cup 37 is biased into the radially retracted position. However, as shown particularly in FIG. 6, in response to an increase in fluid pressure in the annulus formed between pump outlet 32 following a failure of seal integrity between annular seal 36 and the inner surface 17 of inlet conduit 14, fluid pressure acts against the inner surface of pressure cup 37 to flare outwardly the second end of pressure cup 37 such that pressure cup 37 is disposed in a second or radially expanded position where at least a portion of the outer surface of pressure cup 37 sealingly engages the inner surface 17 of inlet conduit 14. Pressure cup 37 includes a first radially outer diameter when in the radially retracted position and a second radially outer diameter when in the radially expanded position that is greater than the first radially outer diameter.

The failure of annular seal 36 may be detected by control system 70 via seal failure pressure sensor 63, which may detect an increase in fluid pressure above atmospheric pressure in response to a leak of pressurized fluid past annular seal 36. In response to detecting the failure of annular seal 36, control system 70 may be configured to issue an alert to a user or operator of pumping system 10 indicating the failure of annular seal 36 (e.g., via an audible or graphically illustrated alarm). Control system 70 may also be configured to shut off pump 30 and to actuate one or more of valves 24A, 24B, 26A, 26B in response to seal failure pressure sensor 63 detecting a failure of annular seal 36 to thereby depressurize and isolate inlet conduit 14 and pump outlet 32. With inlet conduit 14 bled down, the elastomeric material comprising pressure cup 37 biases pressure cup 37 into the radially retracted position, permitting pump outlet 32 to be removed from inlet conduit 14.

As previously described, in conventional hydraulic fracturing operations the pumps of the pumping system of the fracturing operation must be manually disconnected by personnel of the pumping system in order to be serviced or replaced. The manual disconnection of the pumps requires personnel of the pumping system to enter into proximity of the high pressure manifold of the pumping system, thereby requiring the depressurization of the high pressure manifold to allow personnel of the pumping system to safely disconnect the pump. With the high pressure manifold of the pumping system depressurized, the hydraulic fracturing operation must be stalled until the manifold can be brought back online, increasing the total time required for performing the fracturing operation.

Referring now to FIGS. 1-6, pumping system 10 allows pump 30 to be safely connected to and disconnected from high pressure manifold 12 without depressurization of manifold 12, thereby expediting the hydraulic fracturing operation performed by pumping system 10. More specifically, during normal pumping operations with pumping system 10, inlet valve 24A, 24B are in the open positions while branch valve 26A, 26B and dump valve 28 are in the closed positions to isolate pump 30 from dump conduit 20, and thereby allow pump 30 to supply pressurized fluid to manifold 14 via outlet 32 and inlet conduit 14. Lock 106 of connector assembly 100 (or connector assembly 150) is in the locked position to lock pump outlet 32 within inlet conduit 14 during pumping operations.

During pumping operations, pump 30 may become worn or damaged due to abrasive materials present in the fluid pumped by pump 30. If the damage is sufficiently great, pump 30 may require maintenance, repair, or replacement. Unlike conventional pumping systems, in embodiments described herein, pumping system 10 can be operated with control system 70 to safely disconnect pump 30 from high pressure manifold 12 without depressurizing manifold 12. In particular, pump 30 is first shut down and then first inlet valve 24A and second inlet valve 24B are each closed to isolate pump outlet 32 and branch conduits 18A, 18B from high pressure manifold 12. Next, with valves 24A, 24B, 26B closed, second branch valve 26B and dump valve 28 are each opened to permit pressurized fluid in a first portion 14A of inlet conduit 14 extending between second branch valve 26B and terminal end 16 to drain through dump conduit 20, thereby depressurizing the first portion 14A of inlet conduit 14. Following the depressurization of the first portion 14A of inlet conduit 14, the pressure within the first portion 14A of inlet conduit is remotely monitored via first inlet pressure sensor 60A and interface 76 of control system 70 to confirm second inlet valve 24B and first branch valve 26A each remain closed and sealed to isolate pump 30 and dump conduit 20 from high pressure manifold 12.

Next, dump valve 28 and second branch valve 26B each remain open while first branch valve 26A is opened to permit fluid disposed in a second portion 14B of inlet conduit 14 extending between inlet valves 24A and 24B to drain through dump conduit 20, thereby depressurizing the second portion 14B of inlet conduit 14. Following the depressurization of the second portion 14B of inlet conduit 14, branch valves 26A and 26B are each closed and the pressure within the second portion 14B of inlet conduit 14 is remotely monitored via first inlet pressure sensor 60A and interface 76 of control system 70 to confirm that first inlet valve 24A and second branch valve 26B each remain closed and sealed to isolate pump 30 and dump conduit 20 from high pressure manifold 12. In some embodiments, the pressure within the portion of dump conduit 20 extending between branch conduit 18B and dump valve 28 is monitored via pressure sensor 62 and interface 76 of control system 70 to confirm that valves 26A, 26B remain closed and sealed to isolate pump 30 and inlet conduit 14 from dump conduit 20. It should be appreciated that the sequence of opening and closing of valves 24A, 24B, 26A, 26B, 28 ensures that manifold 12 is isolated from pump 30 at each step in the process by at least two redundant valves (i.e., a "dual" seal). In particular, inlet valves 24A, 24B provide a dual seal between pump 30 and manifold 12 along inlet conduit 14 between manifold 12 and pump 30 when valves 26A, 26B, and 28 are open. In addition, it should be appreciated that when valves 24A, 24B, 26A, 26B, 28 are closed, manifold 12 is isolated from pump 30 and dump conduit 20 by at least two at least two redundant valves. In particular, inlet valves 24A, 24B provide a dual seal between manifold 12 and pump 30 along inlet conduit 14, and branch valves 26A, 26B and dump valve 28 provide a dual seal between high pressure manifold 12 and dump conduit 20.

Following the successful closure of valves 24A, 24B, 26A, 26B, 28, depressurization of inlet conduit 14, and isolation of dump conduit 20 and pump 30 from manifold 12, connector assembly 100 (or connector assembly 150) is remotely unlocked via control system 70 to permit the safe disconnection of pump 30 from inlet conduit 14. In particular, control system 70 controls actuators 108 to transition lock 106 from the locked position to the unlocked position. In embodiments employing connector assembly 150, control system 70 controls actuators 156 to transition cams 152 from the engaged to disengaged positions. Next, movable platform 50 is moved to pull outlet 32 of pump 30 from inlet conduit 14, thereby decoupling pump 30 from inlet conduit 14 for maintenance, repair, replacement or combinations thereof.

Once pump 30 has been serviced, repaired, replaced, or combinations thereof, movable platform 50 connects pump 30 (or a replacement pump 30) to inlet conduit 14. In particular, with pump 30 disposed on movable platform 50 and lock 106 in the unlocked position (and cams 152 in the disengaged position in embodiments including system 150), platform 50 is moved to stab pump outlet 32 into inlet conduit 14 to position outlet seal 36 in sealing engagement with inlet conduit 14. Flexible hose 35 of pump outlet 32 may facilitate aligning the terminal end 33 of pump outlet 32 with the terminal end 16 of inlet conduit 14 when terminal end 33 of pump outlet 32 is stabbed into inlet conduit 14. With pump outlet 32 sufficiently stabbed into inlet conduit 14, control system 70 transitions lock 106 to the locked position, thereby securing pump outlet 32 to inlet conduit 14. In embodiments including system 150, control system 70 transitions cams 152 to the engaged positon prior to transitioning lock 106 to the locked position.

Next, second branch valve 26B and dump valve 28 are opened via control system 70 to provide fluid communication between pump outlet 32 and dump conduit 20. With valves 26B, 28 open, pump 30 is "primed" or activated to begin pumping fluid through conduits 18B, 20. Pressure within dump conduit 20 is monitored remotely via dump pressure sensor 62 and the interface 72 of control system 70. Once the discharge of pump 30 is at the desired operating pressure, pump outlet 32 of pump 30 is brought into fluid communication with high pressure manifold 12. In particular, valves 26B, 28 are closed, and valves 24A, 26A remain closed while valve 24B is opened via control system 70. Pressure within inlet conduit 14 is monitored remotely via inlet pressure sensors 60A, 60B to confirm the successful actuation of inlet valve 24B and ensure the desired fluid pressure within inlet conduit 14 is attained. Next, valve 24A is opened, while valve 24B remains open and valves 26A, 26B, 28 remain closed to allow fluid communication between pump 30 and manifold 12 via inlet conduit 14.

In the manner described above, pump 30 may be safely connected and disconnected to the high pressure manifold 12 of pumping system 10 without depressurizing manifold 12. Particularly, pump 30 may be safely connected and disconnected from high pressure manifold 12 without operators of pumping system 10 (or other personnel) crossing the safety line 80 due to the functionality provided by control system 70 and connector assembly 100, 150. In some embodiments, the actuation of connector assembly 100 and valves 24A, 24B, 26A, 26B, 28 may be performed via the interface 76 of control system 70. However, in other embodiments, actuation of connector assembly 100 and/or valves 24A, 24B, 26A, 26B, 28 may be performed automatically via an algorithm executed by control system 70.

While embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A pumping system for performing a hydraulic fracturing operation, comprising:

a first fluid conduit having a central axis and in fluid communication with a subterranean borehole;

a fluid surface pump including a pump body and a pump outlet extending from the pump body, wherein the pump outlet comprises a flexible conduit extending from the pump body towards a terminal end of the pump outlet, wherein the terminal end of the pump outlet is configured to discharge a fracturing fluid pressurized by the surface pump through the first fluid conduit, and wherein the surface pump is insertable into the first fluid conduit whereby the surface pump is configured to discharge the fracturing fluid into the subterranean borehole;

a connector assembly comprising an engagement member having a first position configured to lock the pump outlet within the first fluid conduit and a second position configured to unlock the pump outlet from the first fluid conduit, wherein the pump outlet is prevented from being removed from the first fluid conduit with the engagement member in the first position and the pump outlet is allowed to be removed from the first fluid conduit with the engagement member in the second position, and an annular pressure cup coupled to an outer surface of the pump outlet, wherein the pressure cup comprises a radially retracted position whereby an outer surface of the pressure cup is spaced from an inner surface of the first fluid conduit when the pump outlet is inserted into the first fluid conduit, and a radially expanded position radially spaced from radially retracted position whereby the outer surface of the pressure cup sealingly engages the inner surface of the first fluid conduit when the pump outlet is inserted into the first fluid conduit.

2. The pumping system of claim 1, wherein the connector assembly comprises a plurality of the engagement members, wherein each engagement member has a first position configured to lock the pump outlet within the first fluid conduit and a second position configured to unlock the pump outlet from the first fluid conduit;

wherein the first fluid conduit includes a plurality of circumferentially-spaced slots extending radially therethrough; and wherein each engagement member is moveably disposed in one of the plurality of slots.

3. The pumping system of claim 2, wherein each engagement member comprises an elongate finger having a longitudinal first end fixably coupled to the first fluid conduit and a longitudinal second end opposite the first end, wherein the second end of each finger is configured to flex about the first end to move the second end radially relative to the first fluid conduit, and wherein each finger includes a tab extending radially inward from the second end and configured to engage an annular shoulder on the pump fluid conduit when the engagement member is in the first position.

4. The pumping system of claim 2, wherein each engagement member comprises a cam pivotably coupled to the first fluid conduit.

5. The pumping system of claim 1, wherein the connector assembly further comprises an annular lock disposed about the first fluid conduit and configured to selectably lock the engagement member in the first position.

6. The pumping system of claim 5, wherein the connector assembly further comprises an actuator configured to actuate the lock between an unlocked position and a locked position.

7. The pumping system of claim 1, further comprising a control system configured to remotely actuate the engagement member of the connector assembly between the first position and the second position.

8. The pumping system of claim 7, further comprising at least one valve disposed along the first fluid conduit, wherein the valve is configured to be actuated from an open position to a closed position by the control system to isolate the pump outlet from a manifold coupled to the first fluid conduit.

9. The pumping system of claim 1, wherein the pump outlet slidingly engages the first fluid conduit and is configured to travel axially through the first conduit when the connector assembly is in the first position with the outlet locked within the first fluid conduit.

10. The pumping system of claim 1, wherein the terminal end of the pump outlet slidingly engages the first fluid conduit and the connector assembly is configured to allow the terminal end of the pump outlet to travel axially travel further into the first fluid conduit when the connector assembly is in the first position with the outlet locked within the first fluid conduit.

11. A pumping system for performing a hydraulic fracturing operation, comprising:

a first fluid conduit having a central axis and in fluid communication with a subterranean borehole;

a fluid surface pump comprising a pump body and a pump outlet extending from the pump body, wherein the pump outlet comprises a flexible conduit extending from the pump body towards a terminal end of the pump outlet, wherein the terminal end of pump outlet is insertable into the first fluid conduit whereby the surface pump is configured to discharge the fracturing fluid into the subterranean borehole;

a connector assembly comprising an engagement member having a first position configured to lock the pump outlet to the first fluid conduit and a second position configured to unlock the pump outlet from the first fluid conduit, wherein the pump outlet is prevented from being removed from the first fluid conduit with the engagement member in the first position and the pump outlet is allowed to be removed from the first fluid conduit with the engagement member in the second position;

a control system configured to remotely actuate the engagement member of the connector assembly between the first position and the second position; and an annular pressure cup coupled to an outer surface of the pump outlet, wherein the pressure cup comprises a radially retracted position whereby an outer surface of the pressure cup is spaced from an inner surface of the first fluid conduit when the pump outlet is inserted into the first fluid conduit, and a radially expanded position radially spaced from radially retracted position whereby the outer surface of the pressure cup sealingly engages the inner surface of the first fluid conduit when the pump outlet is inserted into the first fluid conduit.

12. The pumping system of claim 11, wherein the first position of the engagement member comprises a radially inner position and the second position comprises a radially outer position, and wherein the engagement member is configured to engage a shoulder formed on the pump outlet when the engagement member is disposed in the radially inner position.

13. The pumping system of claim 11, wherein the engagement member comprises an elongate finger having a longitudinal first end fixably coupled to the first fluid conduit and a longitudinal second end opposite the first end, wherein the second end of each finger is configured to flex about the first end to move the second end radially relative to the first fluid conduit, and wherein each finger includes a tab extending radially inward from the second end and configured to engage an annular shoulder formed on the pump outlet when the engagement member is in the radially inner position.

14. The pumping system of claim 11, wherein the engagement member comprises a cam that is pivotably coupled to the first fluid conduit by a pivot joint.

15. The pumping system of claim 11, wherein the connector assembly further comprises:

an annular lock disposed about the first fluid conduit and configured to selectably lock the engagement member in the first position; and an actuator configured to actuate the lock between an unlocked position and a locked position;

wherein the actuator is controllable by signals transmitted from the control system.

16. The pumping system of claim 11, further comprising:

a pair of inlet valves disposed along the first fluid conduit, wherein the first fluid conduit comprises an inlet conduit extending from a manifold;

a pair of branch conduits extending from the inlet conduit, wherein a branch valve is disposed along each of the pair of branch conduits;

a dump conduit extending from the pair of branch conduits, wherein a dump valve is disposed along the dump conduit; and wherein each of the inlet valves, branch valves, and the dump valve are configured to be actuated from an open position to a closed position by the control system.

17. The pumping system of claim 16, further comprising:

an inlet pressure sensor coupled to the inlet conduit; and a dump pressure sensor coupled to the dump conduit;

wherein the control system comprises an interface configured to indicate pressure measurements made by the inlet pressure sensor and the dump pressure sensor.

18. The pumping system of claim 16, wherein:

the pair of inlet valves provide a dual seal barrier between the manifold and the pump outlet; and wherein the pair of branch valves and the dump valve provide a dual seal barrier between the manifold and an outlet of the dump conduit.

19. The pumping system of claim 11, wherein the terminal end of the pump outlet slidingly engages the first fluid conduit and is configured to move along the central axis relative to the first fluid conduit when the connector assembly is in the first position with the pump outlet locked to the first fluid conduit.

20. The pumping system of claim 11, wherein the pump outlet is permitted to travel further into the first fluid conduit when the connector assembly is in the first position with the pump outlet locked to the first fluid conduit.

* * * * *